US009878261B1

(12) United States Patent
Fung

(10) Patent No.: US 9,878,261 B1
(45) Date of Patent: Jan. 30, 2018

(54) TOY REACTIVE TO A SIGNAL

(71) Applicant: DONGGUAN SILVERLIT TOYS CO., LTD., Dongguan (CN)

(72) Inventor: Choi Kei Fung, Causeway Bay (HK)

(73) Assignee: DONGGUAN SILVERLIT TOYS, CO., LTD., Dongguan (CN)

( * ) Notice: Subject to any disclaimer, the term of this patent is extended or adjusted under 35 U.S.C. 154(b) by 0 days.

(21) Appl. No.: 14/918,452

(22) Filed: Oct. 20, 2015

(51) Int. Cl.
*A63H 30/00* (2006.01)
*A63H 33/26* (2006.01)
*A63H 5/00* (2006.01)

(52) U.S. Cl.
CPC ..... *A63H 33/26* (2013.01); *A63H 5/00* (2013.01)

(58) Field of Classification Search
USPC ..... 446/175, 302, 310, 358, 484; 40/411, 40/414
See application file for complete search history.

(56) References Cited

U.S. PATENT DOCUMENTS 4,738,881 A * 4/1988 Lee ..... A41G 1/002 428/12
4,903,424 A * 2/1990 Satoh ..... A41G 1/002 40/411
4,970,810 A * 11/1990 Liou ..... G09F 19/08 40/411
4,973,891 A * 11/1990 Tzeng ..... A63H 13/00 318/15
4,983,890 A * 1/1991 Satoh ..... A41G 1/002 318/14
5,056,249 A * 10/1991 Sakurai ..... G09F 19/08 40/411
5,090,936 A * 2/1992 Satoh ..... A41G 1/002 40/411
6,045,430 A * 4/2000 How ..... G09F 19/08 40/414
6,389,718 B1 * 5/2002 Joo ..... A41G 1/002 40/412
7,842,359 B2 * 11/2010 Marlow ..... A41G 1/002 428/24
7,861,444 B2 * 1/2011 Marlow ..... A41G 1/002 40/411
7,861,445 B2 * 1/2011 Sui ..... A41G 1/002 40/411
8,597,070 B2 * 12/2013 Chang ..... A63H 33/30 446/175
9,144,258 B2 * 9/2015 Krivanek ..... A41G 1/002
2005/0148279 A1 * 7/2005 Maa ..... A63H 3/28 446/297
2006/0254098 A1 * 11/2006 Fu ..... G09F 19/08 40/411

* cited by examiner

*Primary Examiner* — Kurt Fernstrom
(74) *Attorney, Agent, or Firm* — Jeffrey Yee; Greenberg Traurig, LLP

(57) ABSTRACT

A toy flowerpot with a movable toy flower includes a battery to power a mechanism in the toy flower. The flower includes the parts of a stem, sepal, petals and a front flower face around which the petals are mounted, at least one of which parts is a reactive part. A mechanism moves one or more parts of the flower; and includes an actuator with a magnet and electromagnetic coil with the flower. A signal receiver or sensor of changes causes at least one of movement of the flower parts. A microprocessor processes the signal or sensed change and generates instructions to change the operation of the electromagnetic coil in response to the signal or sensed change.

15 Claims, 14 Drawing Sheets

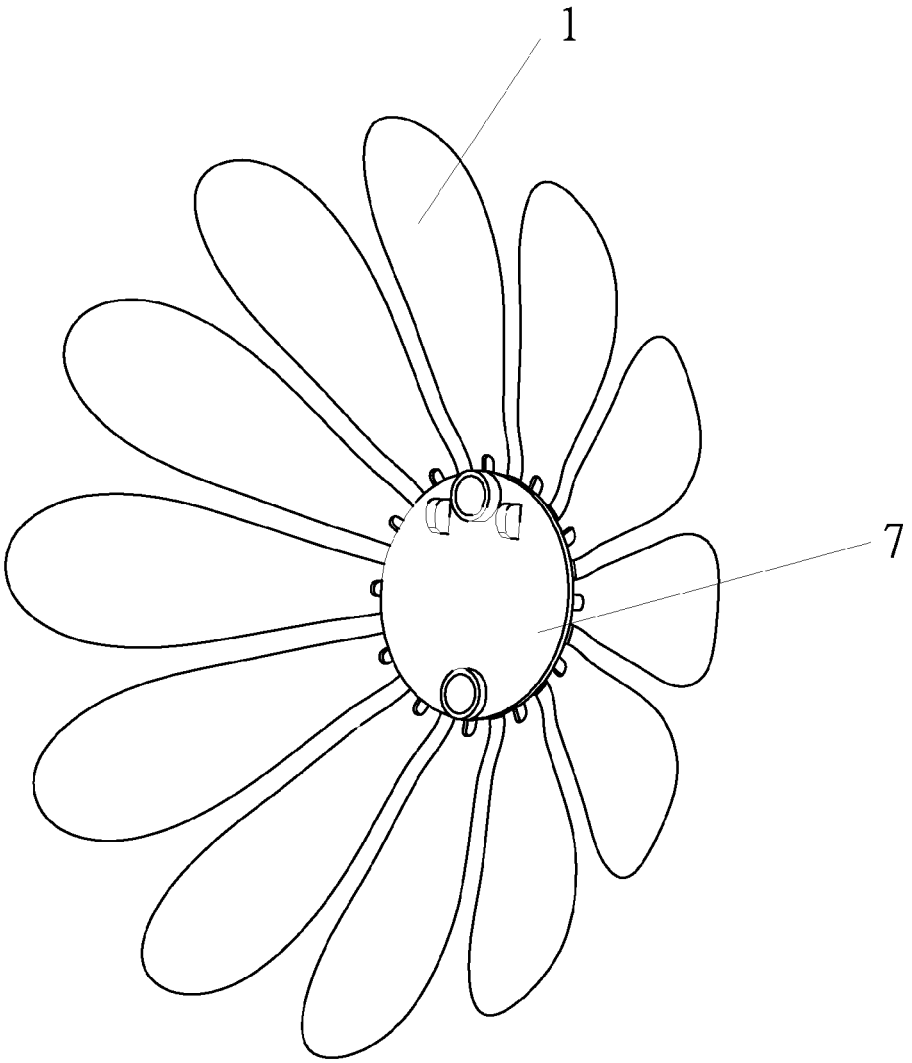
FIG.4-a

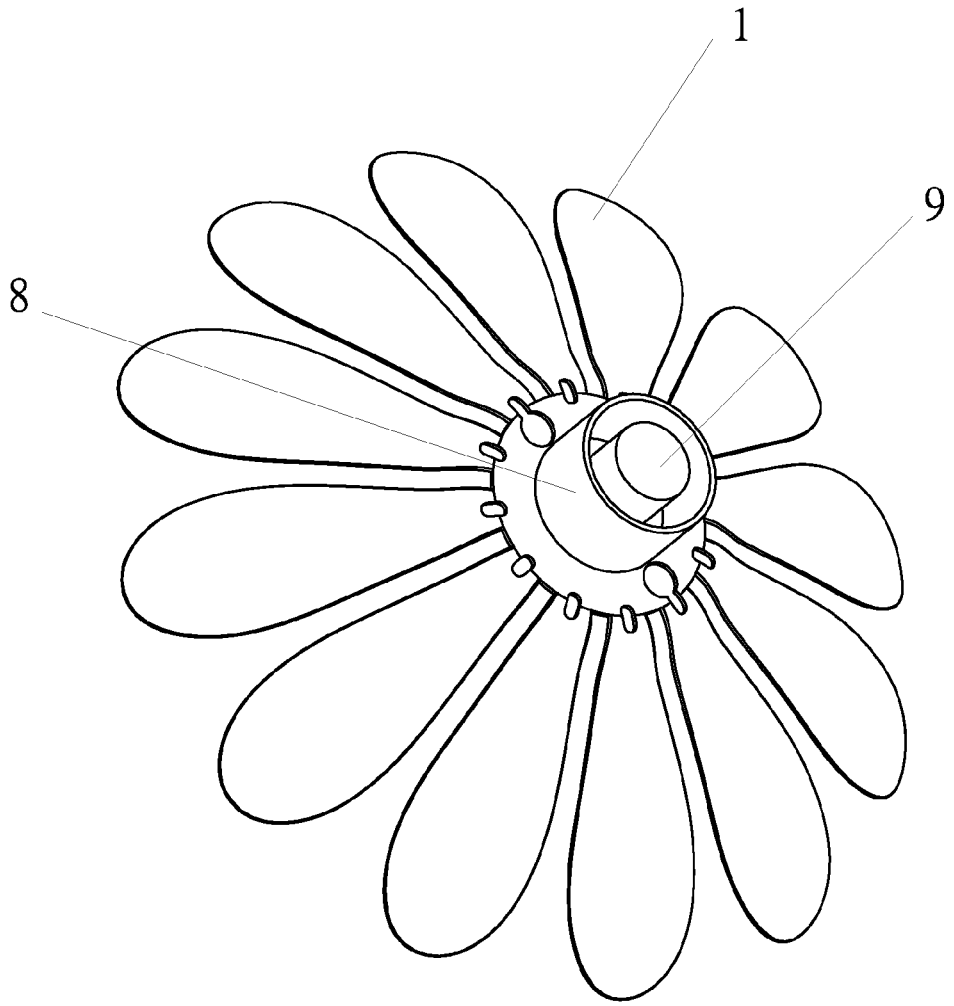
FIG.4-b

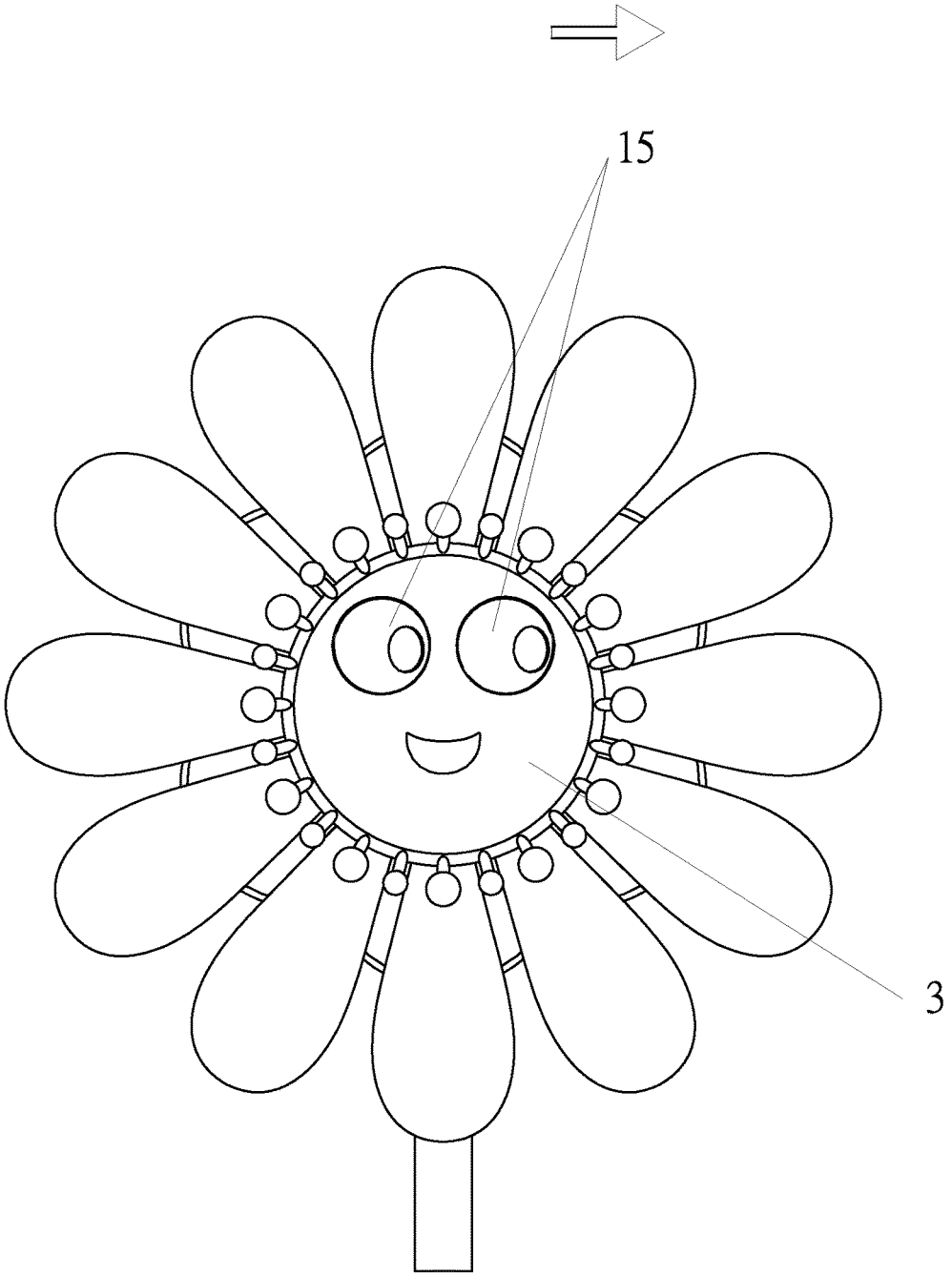
FIG. 11-a

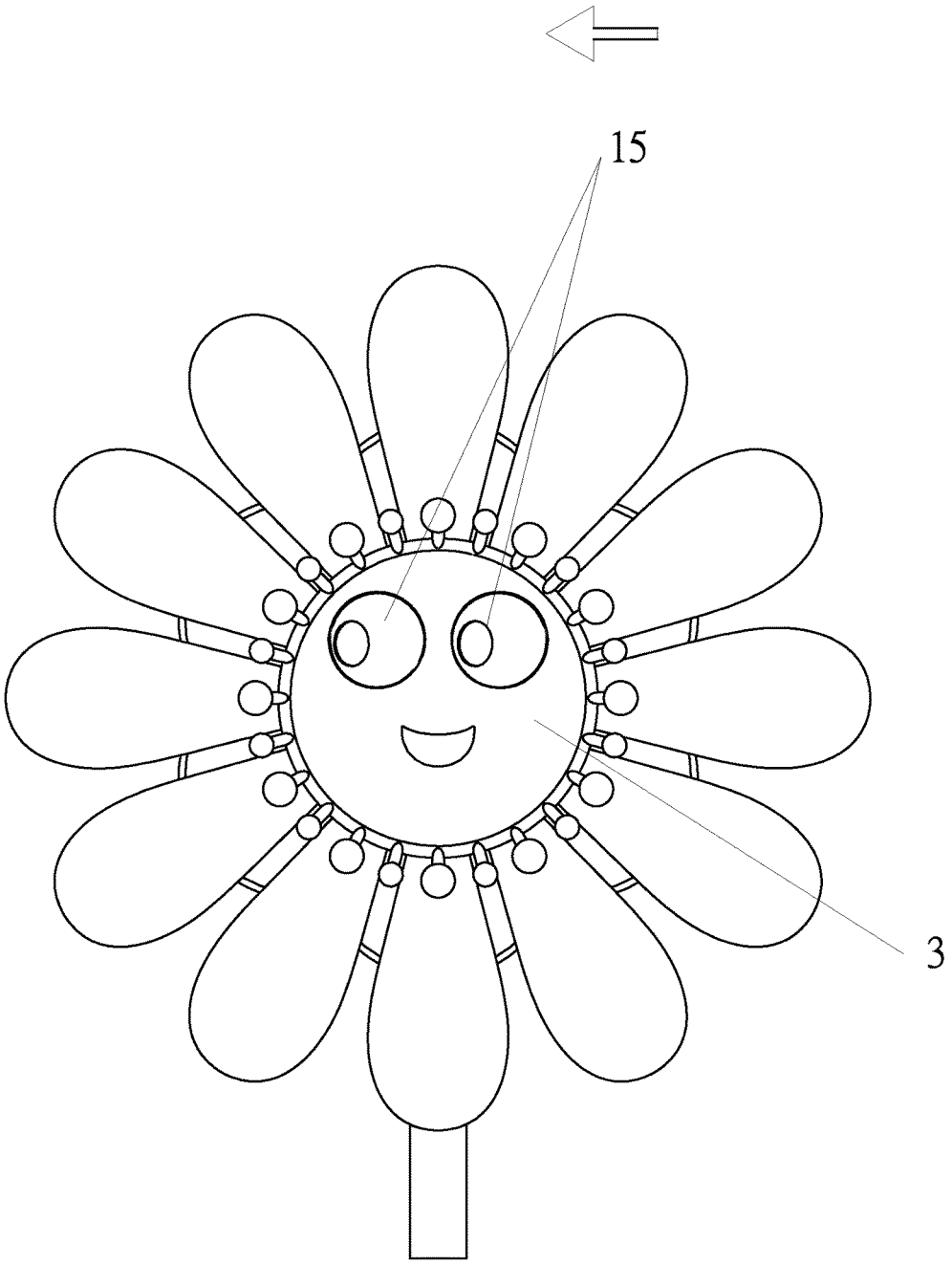
FIG. 11-b

TOY REACTIVE TO A SIGNAL

RELATED APPLICATION

This application relates to application Ser. No. 14/467,886 filed Aug. 25, 2014 issued as U.S. Pat. No. 9,108,115 entitled "Toy Responsive to Blowing or Sound". The content of this application is incorporated by reference herein in its entirety.

FIELD OF DISCLOSURE

The disclosure relates to a toy that can interact with a user of the toy.

The present disclosure is concerned with the technology for one or more toys to be reactive to the sensing, for instance, of sound, movement, moisture, heat, and voltage and to be interactive or independent in their reaction.

SUMMARY OF THE DISCLOSURE

The disclosure is an interactive artificial flower toy and method for operating a flower toy where the toy comprises flower parts and one or more of which are structured to move under the direct or indirect action of movement of a magnet operated by an electromagnetic coil.

A sensor is located with the flower toy for sensing a sound, movement, voltage heat or the like caused for instance by a human user in the vicinity of the toy. A microprocessor processes the sensed signal generates instructions in response to, the instructions causing operation of one or more reactive portions of the toy. There can be a speaker for emitting sound as part of the operation. A reaction by the first flower toy can cause a responsive reaction by the second flower toy.

The sound can be provided by a user or one of the toys or of multiple toys. Many flower toys can be interactive to develop a reaction of other flower toys to the sensing.

BRIEF DESCRIPTION OF THE DRAWINGS

The novel features of this disclosure, as well as the disclosure itself, both as to its structure and its operation, will be best understood from the accompanying drawings, taken in conjunction with the accompanying description, in which similar reference characters refer to similar parts, and in which:

FIG. 4*a*. Front view of petal

FIG. 4*b*. Rear view of petal

DETAILED DESCRIPTION

Figure 1:
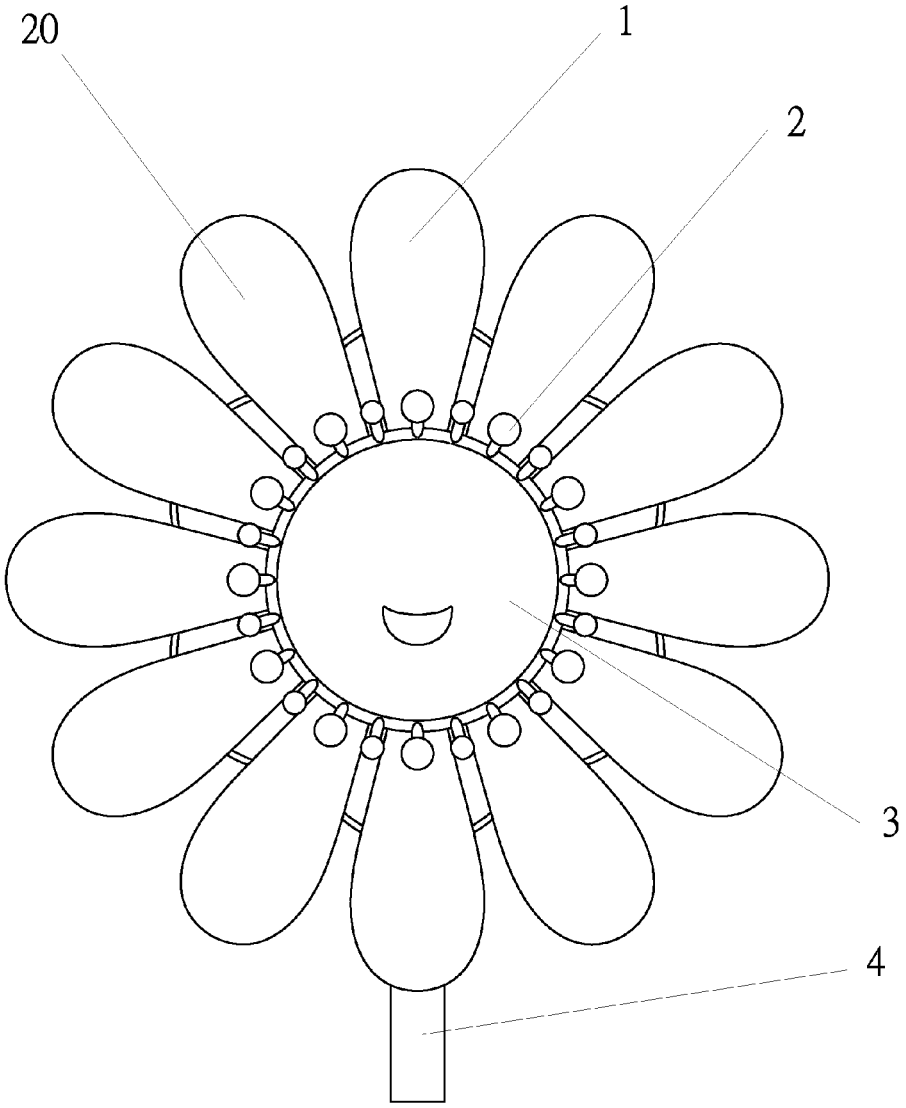
FIG. 1. Front view of artificial flower
Figure 2:
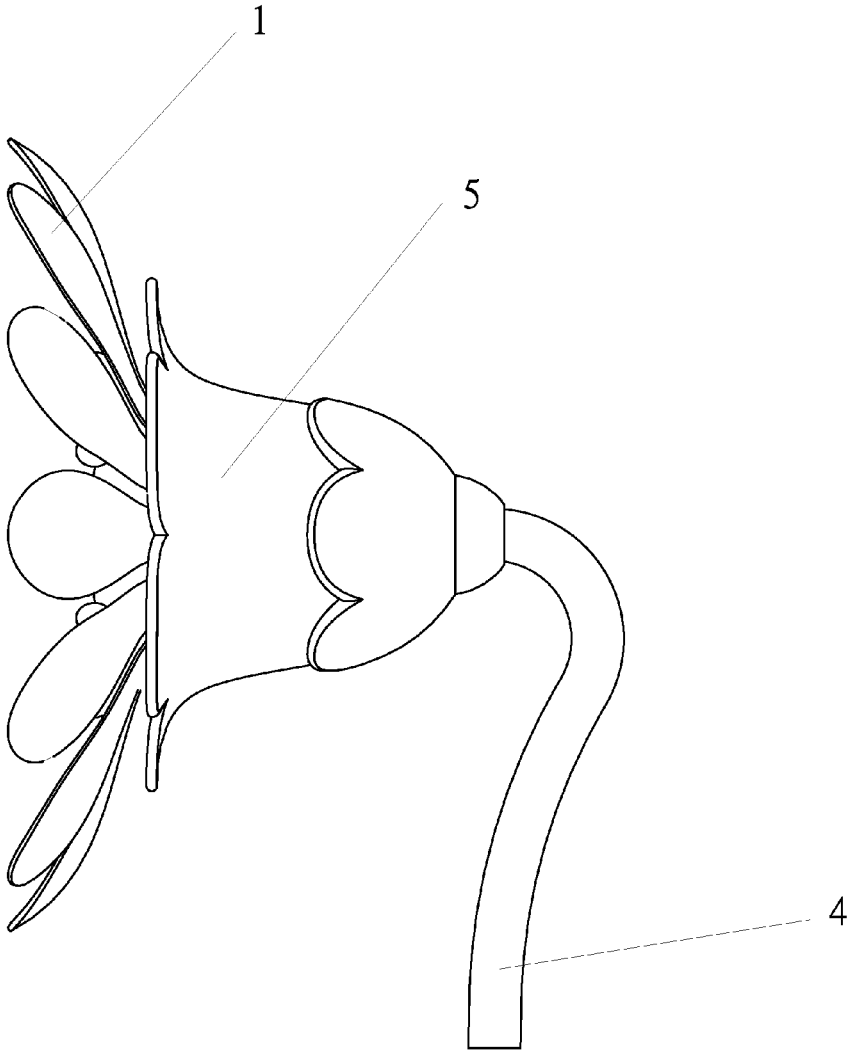
FIG. 2. Side view of artificial flower
Figure 3:
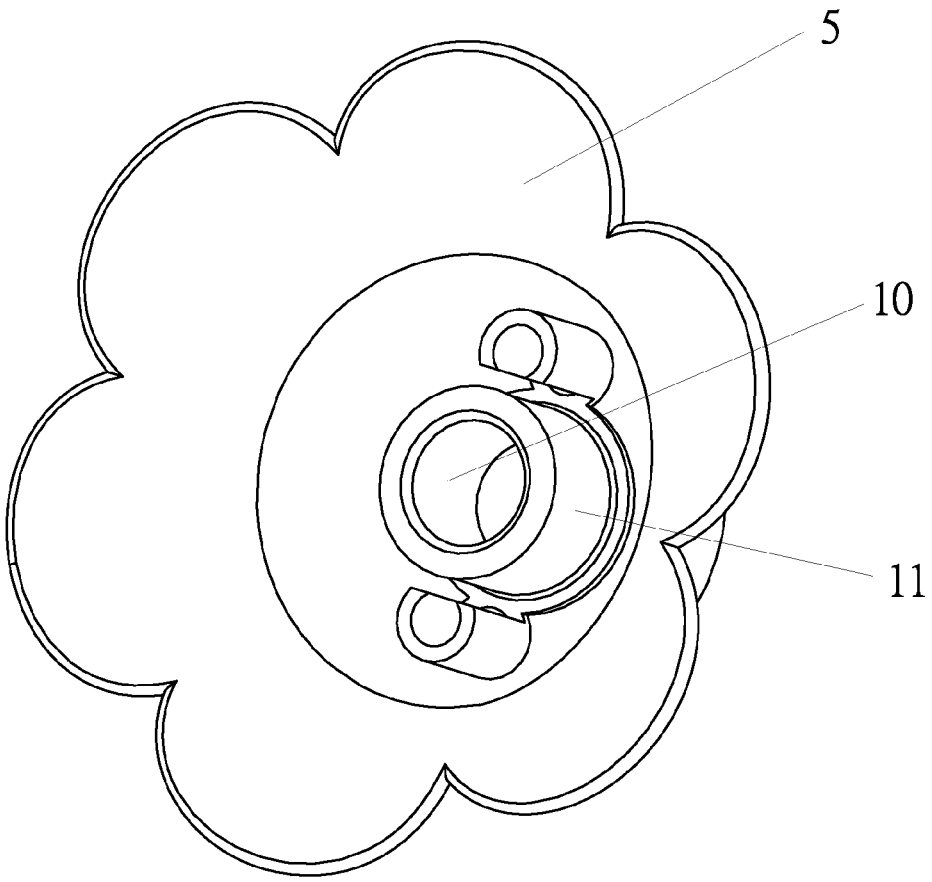
FIG. 3. Exploded view of sepal
Figure 5:
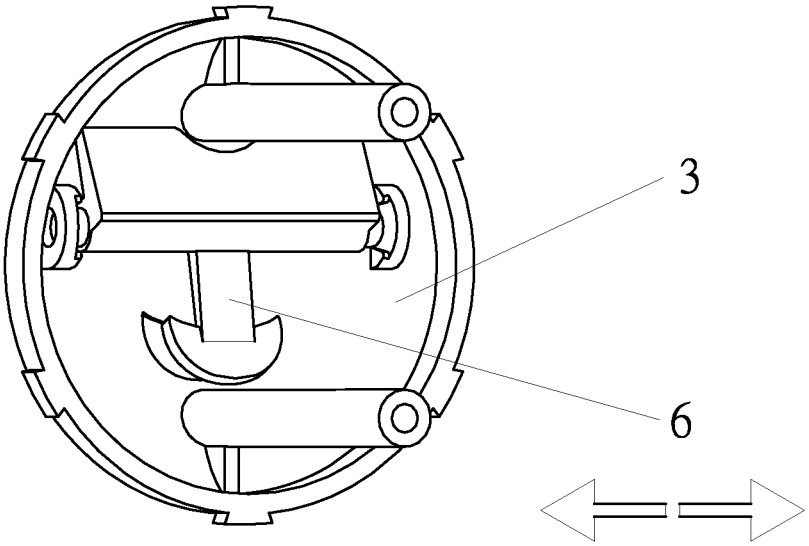
FIG. 5. Rear view of flower face
Figure 6:
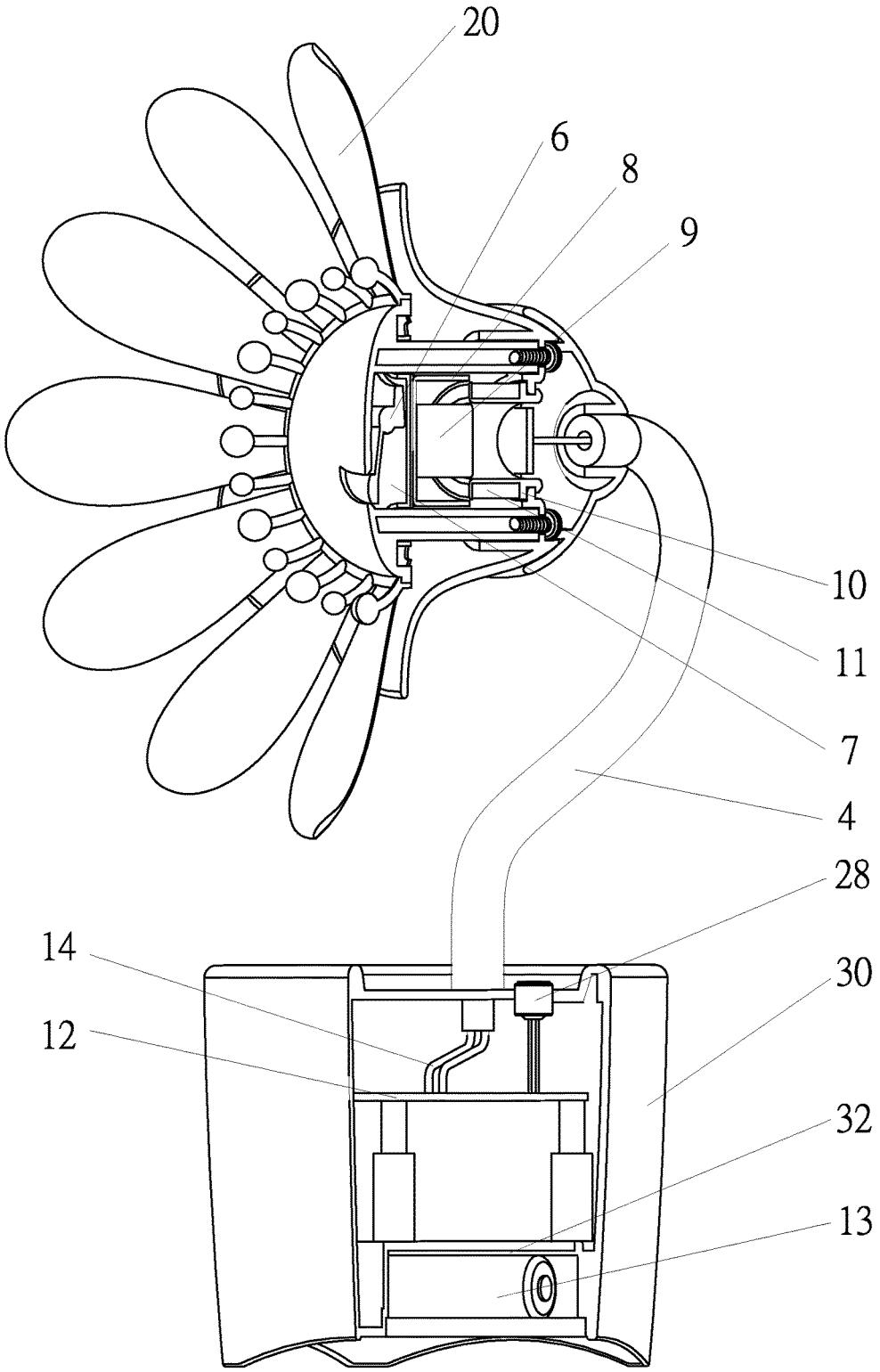
FIG. 6. Cross-sectional view of artificial flower
Figure 7:
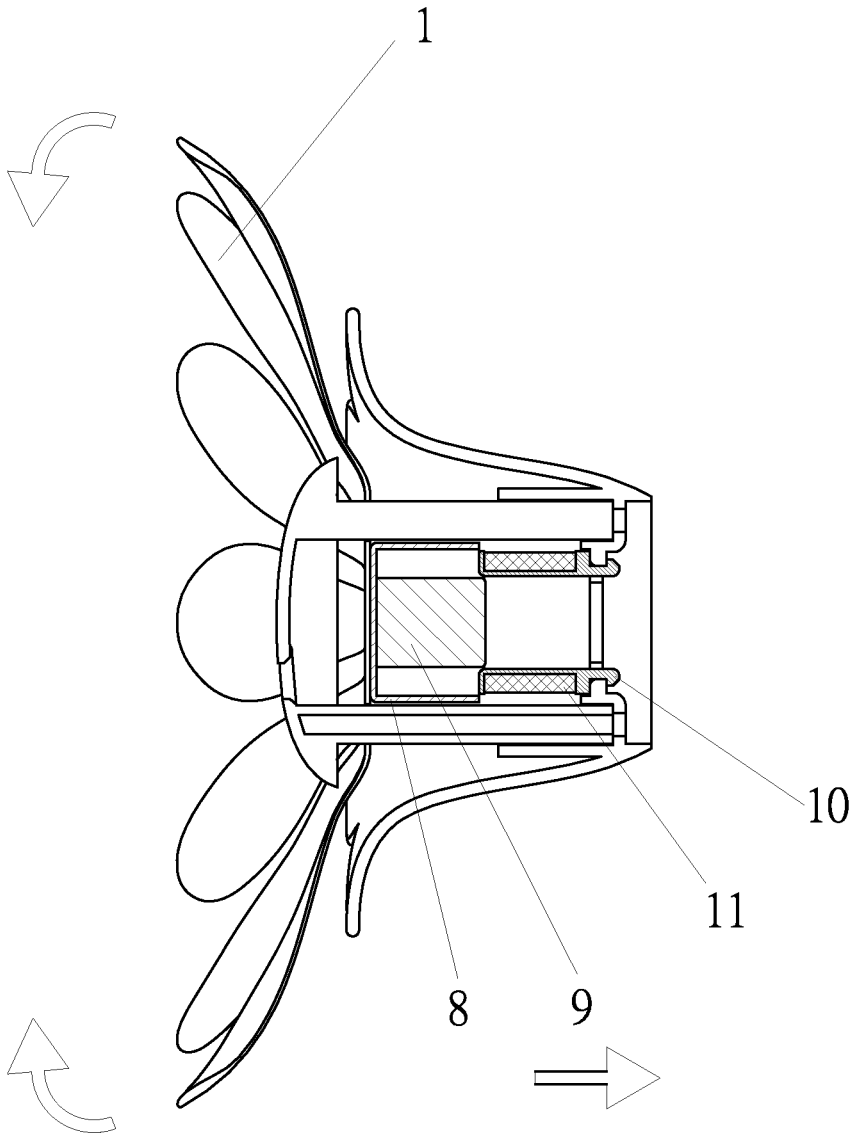
FIG. 7. Exploded view of artificial flower for showing the direction of closing petal and iron and permanent magnet module FIG. 8. Exploded view of artificial flower for showing the direction of opening petal and iron and permanent magnet module FIG. 9. Cross-sectional view of alternative design by swapping the position of iron and magnet module and electric coil FIG. 10. Exploded view of alternative design by putting all electronics and battery inside sepal FIGS. 11*a* and 11*b*. Alternative front views of the flower.
Figure 8:
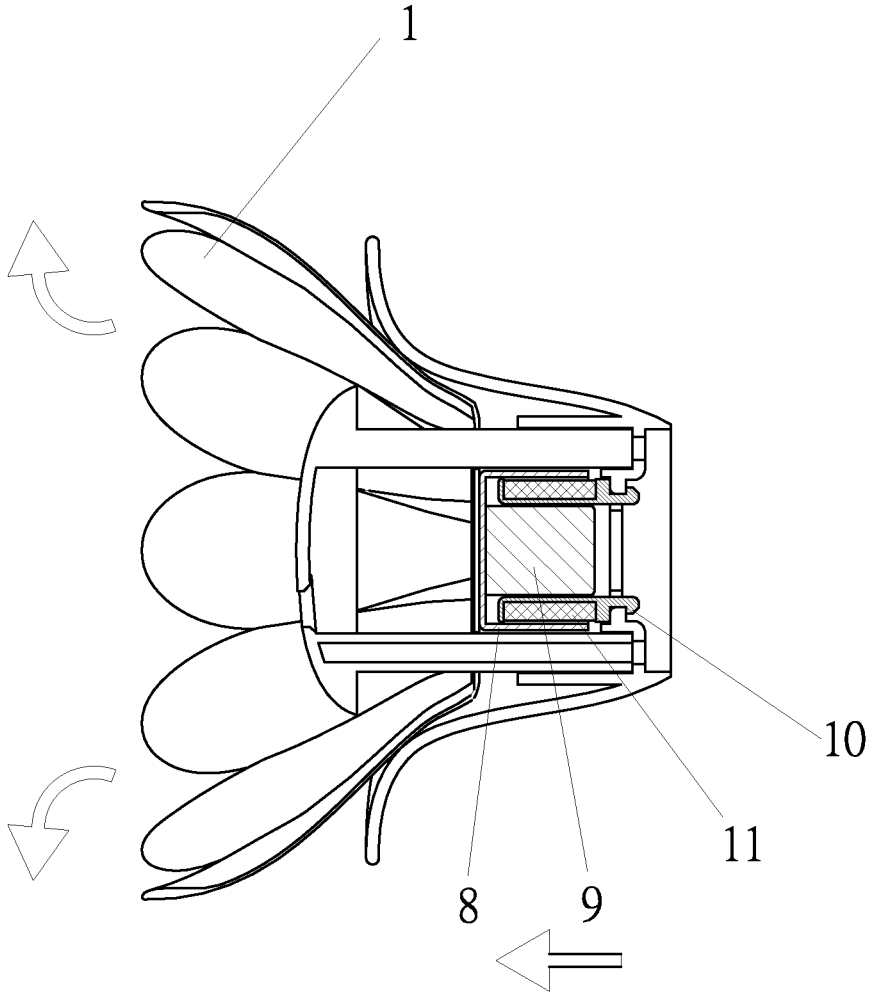

A mechanism simulating a blooming artificial flower includes an electromagnetic actuator, a petal, a sepal and a flower face. By varying the voltage level and/or current direction of the actuator, this mechanism is able to control the petal to open and close with different range and speed.

A toy flowerpot with a movable toy flower, comprises a pot with a wall, a battery compartment within the wall for accommodating a battery to power a mechanism in the toy flower. The flower includes the parts of a stem, sepal, petals and a front flower face around which the petals are mounted, at least one of which parts is a reactive part.

There are wires in the stem of the flower for directing power from the battery to the mechanism for moving one or more parts of the flower. An actuator includes a magnet and electromagnetic coil with the flower. Alternatively the battery is in the flower.

A signal receiver or sensor with the pot or flower receives a signal or senses a change caused by selectively at least one of movement of the flower or an entity in the environment of the flower or pot, temperature, sound in the environment, pressure in the vicinity of the flower or pot.

A microprocessor for processing the received signal or sensed change and generates instructions to change the operation of the electromagnetic coil in response to the signal or sensed change. The instructions cause movement of the magnet and a subsequent reaction of at least one of the reactive parts of the flower.

The signal receiver with the pot or flower receives a change in a signal caused by selectively at least one of a built in rhyme of a song, movement of the flower or an entity in the environment of the flower or pot, temperature, sound in the environment, pressure in the vicinity of the flower or pot and a mechanism in the flower for simulating a blooming artificial flower.

The mechanism includes an electromagnetic actuator, and wherein varying a voltage level and/or current direction of the actuator, the mechanism controls the petal to open and close with a different range and speed.

The toy comprises a mechanism in the flower for simulating a blooming artificial flower, the mechanism including an electromagnetic actuator. Varying a voltage level and/or current direction of the actuator, the mechanism controls the petal to open and close with a different range and speed.

A space in the pot for a battery provides power by wires up the stem of the flower to other parts of the flower. The actuator mechanism is directly or indirectly powered through the wires to effect movement of one or more parts of the flower. This includes having the movement operate to open or close of one or more parts of the flower relative to open and closed positions of the flower.

The mechanism includes one or more tubes connected for longitudinal and/or rotational movement relative to the axis of the tube. The sensor operates through the microprocessor to activate the electromagnetic coil for operation to change the position of a permanent magnet located strategically with the coil and move the tube, and the change in position moves directly or indirectly one or more parts of the flower.

The tube includes a cylindrical iron component. The magnet is affixed at a center and bottom of cylindrical iron, and the actuator provides a motive force to the petal by the reaction of a magnetic field to the current passing through the coil.

The sepal includes a trumpet shaped base. The coil of the actuator and a coil stand are fixed at a base of the sepal, and the tube and magnet of the actuator are fixed at the center of the petal.

The toy includes a plate for pushing a hinged mouth inside the front flower face, the plate being mechanically mounted with the sepal and being hinged to the mouth inside the flower face.

In an alternative form a toy flowerpot with a movable toy flower comprises a battery to power a mechanism in the toy flower. The flower includes the parts of a stem, sepal, petals and a front flower face around which the petals are mounted, at least one of which parts is a reactive part. Connections to direct power from the battery to the mechanism for moving one or more parts of the flower. An actuator includes a magnet and electromagnetic coil with the flower.

A sensor senses a change caused by selectively at least one of movement of the flower or an entity in the environment of the flower, temperature, sound in the environment, pressure in the vicinity of the flower.

A microprocessor processes the sensed change and generating instructions to change the operation of the electromagnetic coil in response to the sensed change. The instructions cause movement of the magnet and a subsequent reaction of at least one of the reactive parts of the flower.

The toy can locate a power circuit and/or power supply inside the sepal.

The mounting the coil can be on a side of the petal and mounting the iron and magnet module on a base for the sepal.

The operation of the actuator without a cylindrical tube thereby reducing the magnetic field strength.

A method of operating a toy flowerpot with a movable toy flower. The steps include directing power from the battery to the mechanism for moving one or more parts of the flower. A magnet operates through power applied to an electromagnetic coil with the flower. A change caused by selectively at least one of movement of the flower or an entity in the environment of the flower or pot, temperature, sound in the environment, pressure in the vicinity of the flower or pot is sensed.

Processing the sensed change and generating instructions changes the operation of the electromagnetic coil in response to the sensed change. The instructions cause movement of the magnet and a subsequent reaction of at least one of the reactive parts of the flower.

When the coil is non-energized, the petal is in neutral, or in a semi open position, and when an electric current is applied to the coil in one direction, the coil becomes an electromagnet and attracts an iron tube and magnet module towards the coil along the longitudinal axis.

An activation module comprising the magnet and coil is fixed at or adjacent a central area of a petal whereby the petal is guided by an open end of trumpet shaped sepal and pulled inside the sepal to present the flower in a closed state, and wherein the petal includes an elastic material and the elastic nature of the petal material causes the petal to return to a neutral position when the coil is de-energized.

The method can apply an opposite current to the coil. This repels the iron and magnet module away from the coil along the longitudinal axis, and thereby the flower petal is represented in an open state.

The method includes operating a pushing plate on a petal to push the hinged mouth inside the flower face and thereby to open the mouth. The petal returns to its neutral position and the mouth closes when the coil is de-energized.

The disclosure provides a toy flowerpot with one or more movable toy flowers. The pot can have a space for battery-power to provide power by wires up the stem of the flower to other parts of the flower. In one or more parts of the flowers there is a mechanism directly or indirectly powered through the wires to effect movement of one or more parts of the flower. The movement can include opening and closing of one or more parts of the flower relative to open and closed positions of the flower. The mechanism can includes one or more tubes connected for longitudinal and/or rotational movement relative to the axis of the tube. There are one or more sensors for activating movement of the tube. The sensors can be strategically placed in the pot or a part of the flower and can operate through a PCBA to activate the tube. There is also an electromagnetic coil for operation to change the position of a permanent magnet located strategically with the coil. This change in position can move directly or indirectly one or more parts of the flower.

The artificial flower blooming mechanism includes

1. Electromagnetic actuator
   - It comprises 3 parts
     - a. Electric coil
     - b. Cylindrical iron
     - c. Permanent magnet fixed at the center and bottom of cylindrical iron
   - The actuator provides the motive force to the petal by the reaction of a magnetic field to the current passing through it.
2. Sepal
   - It is a hard plastic trumpet shaped base
   - Electric coil of the actuator and coil stand are fixed at the Sepal base
3. Petal
   - It can be made of soft material such as PP, PE, PVC, fabric material, paper . . . etc.
   - Iron and permanent magnet module of the actuator are fixed at the center of petal
   - A plate for pushing a hinged mouth inside flower face
4. Flower face
   - It is mechanically mounted on sepal
   - Hinged mouth inside the flower face
   - An elastic stamen
5. Stem & leaves
   - Hollow stem
   - For decoration purpose According to the present embodiment, the flower stem is hollow, it allows 2 coil wires to pass through the stem so that the coil can be connected to an electrical power source inside a pot. Without energizing the coil, the petal is in neutral, semi open position. When an electric current is applied to the coil in one direction, the coil becomes an electromagnet and it attracts the iron and permanent magnet module towards the coil along the longitudinal axis.

As this module is fixed at the center of petal, the petal will be guided by the open end of trumpet shaped sepal and pulled inside the sepal. Then the flower will be in close state. Due to the elasticity nature of the petal material, the petal will return to its neutral position when the coil is de-energized.

Similarly, when opposite current is applied to the coil, it repels the iron and permanent magnet module away from the coil along the longitudinal axis. The flower petal will be in open state. Additionally, the pushing plate on petal will push the hinged mouth inside flower face so as to open the mouth simultaneously. Again, the petal will return to its neutral position and the mouth will close when the coil is de-energized Ampere's Law relates that the magnetic field of a coil is directly proportional to the applied current and hence applied voltage.

1. By applying different voltage levels to the coil, different magnetic field strength and therefore different petal moving range can be achieved.
2. By changing the coil voltage polarity, magnetic field direction can be reversed in 180° so that the petal can change from opening to closing state or vice versa.
3. By applying rate of voltage change or rate of Pulse Width Modulation (PWM) change, different petal moving speed can be obtained.

All above coil control functions can be easily implemented by driving the electric coil with a low cost microcontroller.

Alternative designs include

Figure 9:
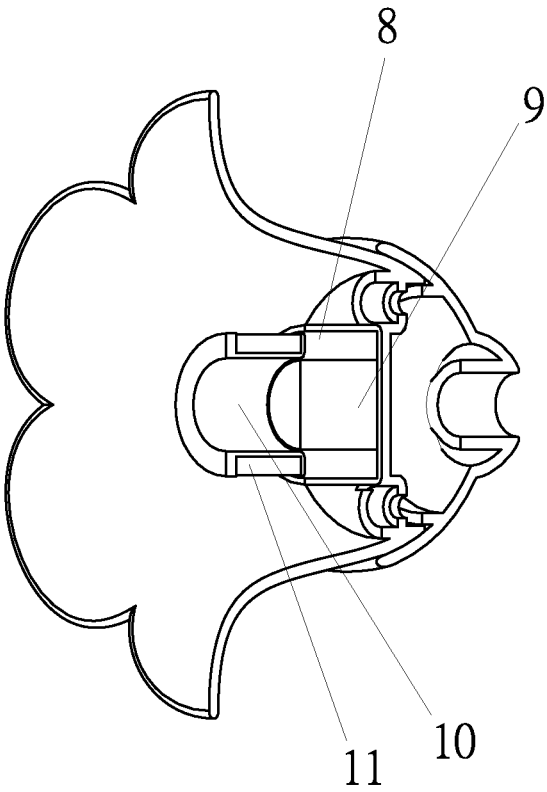
Figure 10:
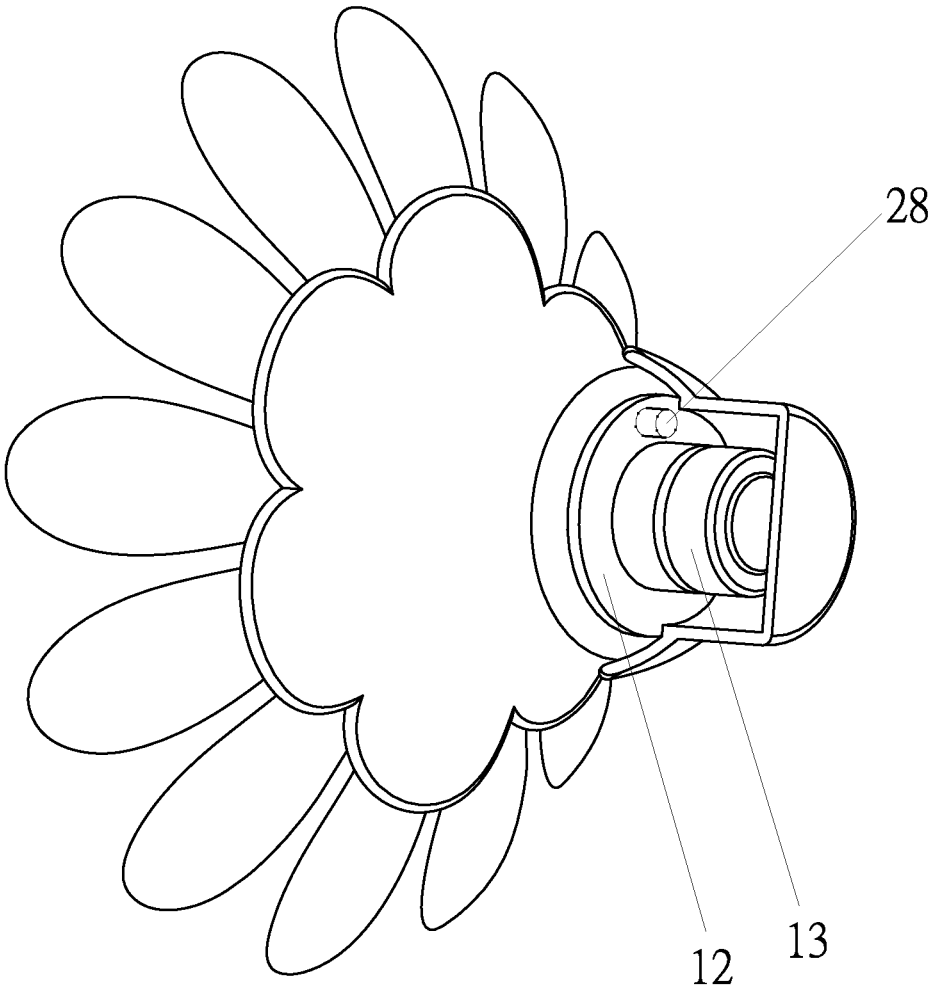
Figure 12:
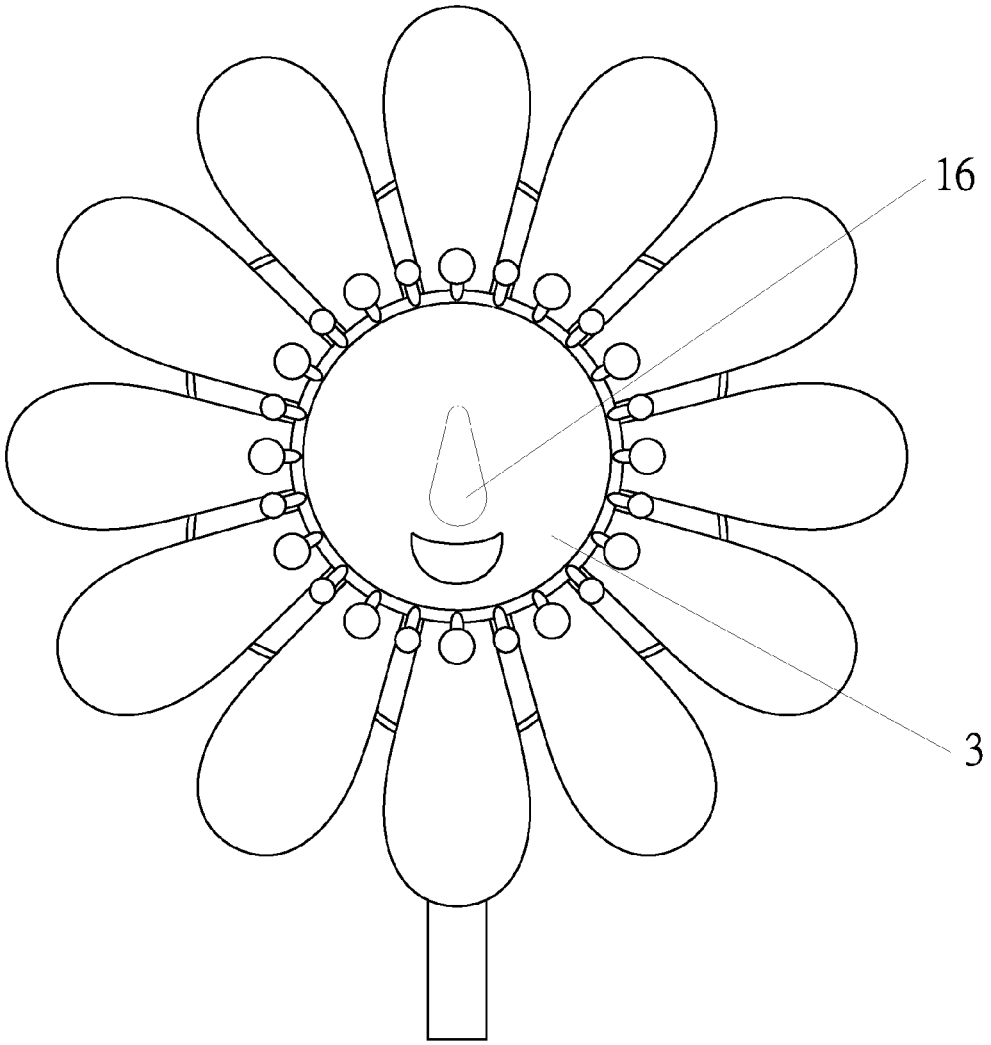
FIG. 12. Alternative front view of the flower.

1. Mount an electric coil on petal side and mount the iron and permanent magnet module on sepal base. (FIG. 9)
2. When long travel distance of electromagnetic actuator is not required, the cylindrical iron is removed so as to reduce the magnetic field strength.
3. Put the power circuit and/or power supply inside the sepal rather than a pot. (FIG. 10)
4. The artificial flower blooming effect is activated by triggering different types of sensor such as light sensor, sound level sensor, touch sensor, motion sensor, moisture sensor . . . etc.

Apart from hinged mouth, pushing plate can also be used to activate different facial expression such as moving eyes, nose, ears . . . etc.

Numbering system

| No | Description |
|---|---|
| 1 | Petal |
| 2 | Stamen |
| 3 | Flower face |
| 4 | Stem |
| 5 | Sepal |
| 6 | Hinged mouth |
| 7 | Pushing plate |
| 8 | Cylindrical iron |
| 9 | Permanent magnet |
| 10 | Coil stand |
| 11 | Electric coil |
| 12 | PCBA |
| 13 | Battery |
| 14 | Wires |
| 15 | Eyes |
| 16 | Nose |
| 20 | Artificial flower |
| 28 | Sensor |
| 30 | Pot |
| 32 | Battery compartment |

A toy flowerpot with a movable toy flower comprises a pot with a wall. There is a battery compartment within the wall for accommodating a battery to power a mechanism in the toy flower. The flower includes the parts of a stem, sepal, petals and a front face around which the petals are mounted. Wiring in the stem of the flower is for directing power from the battery to the mechanism for moving one or more parts of the flower.

A toy flower pot for an artificial flower 20 includes a pot 30, a battery source 13 and wires 14 directed up the stem 4 of the flower 20.

The disclosure is an interactive toy comprising the pot and flower. A microprocessor generates signals to sequentially activate and deactivate an electric coil thereby to sequentially attract and release a magnet thereby to cause movement of one or more parts of the interactive flower toy. The movement causes relative changes in position between a non-reactive portion and a reactive portion of the flower toy.

The interactive toy is a flower, and the flower has a Petal, Stamen, Flower face, stem and sepal. One or more of these parts is a reactive portion and one or more of these parts is a non-reactive portion. The changes in position of the first reactive portion are exhibited as the sequentially opening and closing for instance the mouth in the flower face. A change in position of a second reactive portion is exhibited as the opening or closed of eyes or movement of ears and/or opening or closing of petals relative to the face.

The interactive toy can include a speaker in the body of the toy, and the microprocessor can include a routine for analyzing sound in the vicinity of the body, and cause the sound to develop a reaction by the toy, the reaction being the emission of a sound from the speaker.

The microprocessor includes a routine for analyzing different sounds in the vicinity of the toy, and classifying the sounds to develop different reactions by the toy, the reactions being selected as being at least one of from the group of movement of a reactive portion of the toy or the emission of sound from the speaker.

The interactive flower toy can include an aperture for instance in the flower face for receiving the blowing pressure to thereby activate the microprocessor. There is a blow sensor with the body for sensing a pressure caused by blowing on the shell by a human user in the vicinity of the body. A microprocessor processes the blowing pressure and generates instructions in response to the blowing pressure, the instructions cause operation of the reactive portion of the toy. A speaker is provided for emitting sound as part of the operation.

There can be multiple toy flowers of similar construction and operation and for interoperation with each other, such that when the first toy emits a sound a second flower begins to react.

The toy can include a communication module wherein the toy is connectable with a digital input device thereby to link the toy with digital input device through at least one of a USB, Bluetooth, Zigbee or WiFi communication protocol whereby the toy is configured to receive at least one of a predefined object set, voice, melody, song or sound effect from the digital input device.

The disclosure also includes a method of operating an interactive toy comprising including an interactive toy.

Signals are generated to sequentially activate and deactivate a first electric coil; sequentially attracting or releasing a first magnet thereby to cause movement of one or more parts of the interactive toy flower.

In an alternative method format there is provided in the first toy flower a speaker for emitting sound as part of the operation. A second toy flower includes a speaker for emitting sound as part of the operation; a sound sensor with the body.

The method includes analyzing different sounds in the vicinity of the body, classifying the sounds to develop different reactions by the toy flower. The reactions are selected as being at least one of from the group of movement of a reactive portion of the toy or the emission of sound from the speaker. Also there is classifying the sounds to develop different reactions by the toy flower.

The method also includes connecting the toy with a digital input device thereby to link the toy with digital input device through at least one of a USB, Bluetooth, Zigbee or WiFi communication protocol whereby the toy is configured to receive at least one of a predefined object set, voice, melody, song or sound effect from the digital input device.

The can be several toys to be responsive to at least one of the toys or sounds, the responsiveness being generated from the user or from other of the several toys. Thereby there is obtained a multiple reaction of multiple toys as a started from an initial blowing or sound by a user or by a sound generation by of the multiple toys.

There can be a different number of coils driven by different magnets or magnetic systems.

In one form of operation, there are two control methods to drive the coils:

Current flow through a coil in one direction or current flow in opposite direction to activate the coil or no current to deactivate the coil so that the magnet can be attracted to one end, or repelled to other end or in neutral position respectively. A suitable control method is applied in a second coil and magnet pair, and is used to operate a second flower toy.

Start Up

The flower toy listens to the commands in indoor environment within 6-20" range, background noise sometimes may affect the accurateness of command recognition.

Low Battery Detection

When the battery power is low during the play or while the user turns on the flower, the flower toy will generate an alert as a reminder that battery replacement is required.

Interaction with Smartphone App

By using the Smartphone App, the user can send ultrasonic sound command to the flower toy for play the song the user wants.

The flower toy are interactive toy flowers that can move and respond to players' commands in clapping, different sound level or ultrasonic sound command from the Smartphone app.

The toy can include the microprocessor or a second microprocessor, the second microprocessor being selected to operate features selected from the group consisting of handling power management of the toy, controlling at least one or more magnets of the toy, driving an LED and playing sound effect, melody, song and message associated with the toy.

There can be an external memory for data and program storage, and for interacting with the microprocessor.

The interactive toy can include at least one of a microphone sensor for speech recognition input, capacitive sensor for reaction to a touching input, or a proximity sensor for detecting when a user is located at a predetermined distance from the toy.

The microprocessor can include a routine for interactive game play, the routine causing the toy to relate to a user the need to perform one action, and then checking whether the action has been correctly performed. The toy includes a routine for determining the right action relative to a preprogrammed pattern, and providing feedback to a user by causing the toy to react with different selected movements, the movement including selectively at least one of shaking or nodding of a reactive portion or an emission of a sound output.

In one embodiment a toy can be a doll comprising a plush, soft or hard plastic head and body. One or more subsidiary MCUs can be provided for handling power management provided through a battery, controlling coils, magnets and gear boxes through magnet drivers, driving LEDs and playing sound effect, melody, song and messages through an audio output.

There are external SDRAM and Flash memory devices and respectively for data and program storage.

In other forms of the disclosure, recognition of blowing or sound is used as in different applications recently such as Xbox Kinect, Nintendo Wii remote controller and iPhone, or smart phones. Although the disclosure is described of a toy flower, it is possible to apply the disclosure to other toy embodiments.

It will be understood that the toy can be formed of a variety materials and may be modified to include additional routines, processes, switches and/or buttons. It will be further understood that a variety of other types of toys and digital inputs may be used to control the operation of the toy of the present disclosure.

The interactive toy can include several reactive portions of the flower, and there can be a second coil and second magnet. Generating the signals sequentially activates and deactivates the second electrical coil thereby sequentially attracting and releasing a second magnet thereby to cause second movement of the interactive toy. The movement causes relative changes in position between non-reactive portion and other reactive portions of the flower One of ordinary skill will appreciate that although the embodiments discussed above refer to one form of image sensor. There can be other forms of sensors and there could be more than one sensor with the toy and other modes of operation could be used.

In some cases there is the toy artificial flower without the pot.

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the present disclosure.

The invention claimed is:

1. A toy flowerpot with a movable toy flower as an integrated toy comprising a pot being formed by a wall, a battery compartment within the wall for accommodating a battery to power a mechanism in the toy flower;

the flower including the parts of a stem, sepal, petals and a front flower face around which the petals are mounted, at least two of which parts are reactive parts;

wires in the stem of the flower for directing power from the battery to the mechanism for moving two or more parts of the flower;

an actuator including a single magnet and electromagnetic coil in the sepal of the flower;

a signal receiver located at least partly within the pot or the flower for receiving a change in a signal caused by selectively at least one of movement of the flower or an entity in the environment of the flower or pot, temperature, sound in the environment, pressure in the vicinity of the flower or pot;

a microprocessor located at least partly within the pot or the flower for processing the received signal and generating an electrical signal through the wires to change the operation of the electromagnetic coil in response to the sensed change, the electrical signal being for causing solely a linear and non-rotational movement of the magnet and a subsequent reaction of at least two of the reactive parts of the flower, and the electric signal effecting a push linear movement of the magnet and effecting firstly a movement of petals between a first position retracted partly in the sepal and a second position extended from the retracted position in the sepal, and secondly a movement of a representative mouth on the flower and thirdly representative eyes on the flower, the movement of the mouth and the eyes being effected by a single push plate for operating the mouth and eyes.

2. The toy as claimed in claim 1 comprising the signal receiver being in the pot or flower for receiving a change in a signal caused by selectively at least one of a rhyme of a song, movement of the flower or an entity in the environment of the flower or pot, temperature, sound in the environment, pressure in the vicinity of the flower or pot and a mechanism in the flower for simulating a blooming artificial flower, the mechanism including an electromagnetic actuator, and wherein varying a voltage level and/or current direction of the actuator, the mechanism controls the petal to open and close with a different range and speed.

3. The toy as claimed in claim 1 including a space in the pot for a battery to provide power by wires up the stem of the flower to other parts of the flower, including in one or more parts of the flowers including the actuator mechanism being directly or indirectly powered through the wires to effect movement of parts of the flower, and including having the movement operate to open or close of parts of the flower relative to open and closed positions of the flower.

4. The toy as claimed in claim 3 wherein the mechanism includes a tube connected for longitudinal movement relative to the axis of the tube, and a sensor operating through the microprocessor to activate the electromagnetic coil for operation to change the position of a permanent magnet located inside the coil and move the tube, and the change in position moving directly or indirectly one or more parts of the flower.

5. The toy as claimed in claim 4 wherein the tube includes a cylindrical iron component; the magnet being affixed at a center and bottom of cylindrical iron, and wherein the actuator provides a motive force to the petal by the reaction of a magnetic field to the current passing through the coil.

6. The toy as claimed in claim 5 wherein the sepal includes a trumpet shaped base, and wherein the coil of the actuator and a coil stand are fixed at a base of the sepal, and the tube and magnet of the actuator are fixed at the center of the petal.

7. The toy as claimed in claim 6 including a plate for pushing a hinged mouth inside the front flower face, the plate being mechanically mounted with the sepal and being hinged to the mouth inside the flower face.

8. A toy being a movable toy flower as an integrated toy, comprising a battery to power a mechanism in the toy flower;

the flower including the parts of a stem, sepal, petals and a front flower face around which the petals are mounted, at least two of which parts are reactive parts;

connections to direct power from the battery to the mechanism for moving two or more parts of the flower;

an actuator including a magnet and electromagnetic coil with the flower;

a signal receiver located at least partly in the flower for receiving a change in a signal caused by selectively at least one of movement of the flower or an entity in the environment of the flower or pot, temperature, sound in the environment, pressure in the vicinity of the flower or pot;

a microprocessor located at least partly within the pot or the flower for processing the received signal and generating an electrical signal through the wires, the signal being to change the operation of the electromagnetic coil in response to the sensed change, the electrical signal being for causing solely a linear and non-rotational movement of the magnet and a subsequent reaction of at least two of the reactive parts of the flower, and the electric signal effecting a push linear movement of the magnet wherein the electric signal effects the movement of parts without the use of a motor having a rotational part.

9. The toy as claimed in claim 1 including mounting the coil on a side of the petal and mounting the iron and magnet module on a base for the sepal.

10. The toy as claimed in claim 8 including mounting the coil on a side of a petal and mounting the iron and magnet module on a base for the sepal.

11. A method of operating a toy flowerpot with a movable toy flower as an integrated toy, comprising a pot being formed by a wall, a battery compartment within the wall for accommodating a battery to power a mechanism in the toy flower; the flower including the parts of a stem, sepal, petals and a front flower face around which the petals are mounted, at least two of which parts are reactive parts; including the steps of directing power from the battery to the mechanism for moving two or more parts of the flower; operating a magnet through power applied to an electromagnetic coil with the flower;

receiving a change in a signal caused by selectively at least one of a rhyme of a song, movement of the flower or an entity in the environment of the flower or pot, temperature, sound in the environment, pressure in the vicinity of the flower or pot; and processing the signal change and generating an electrical signal to change the operation of the electromagnetic coil in response to the signal change, the electrical signal being for causing solely a linear and non-rotational movement of the magnet and a subsequent reaction of at least two of the reactive parts of the flower, the electric signal effecting a push linear movement of the magnet, fixing an activation module comprising the magnet and coil at or adjacent a central area of a petal whereby the petal is guided by an open end of trumpet shaped sepal and pulled inside the sepal to present the flower in a closed state, and wherein the petal includes an elastic material and the elastic nature of the petal material causes the petal to return to a neutral position when the coil is de-energized, and operating a pushing plate on a petal to push the hinged mouth inside the flower face and thereby to open the mouth, and wherein the petal returns to its neutral position and the mouth closes when the coil is de-energized.

12. The method as claimed in claim 11 wherein when the coil is non-energized, the petal is in neutral, or in a semi open position, and when an electric current is applied to the coil in one direction, the coil becomes an electromagnet and attracts an iron tube and magnet module towards the coil along the longitudinal axis.

13. The method as claimed in claim 11 wherein applying an opposite current to the coil, repels the iron and magnet module away from the coil along the longitudinal axis, and thereby the flower petal is represented in an open state.

14. The method as claimed in claim 11 including effecting at least one of applying different voltage levels to the coil, thereby generating a different magnetic field strength and thereby effecting a different petal moving range; or changing the coil voltage polarity, and reversing the magnetic field direction so that the petal changes from opening to closing state or vice versa; or applying a rate of voltage change or rate of Pulse Width Modulation (PWM) change to obtain a different petal moving speed.

15. The method as claimed in claim 11 wherein a blooming effect of the toy flower is activated by triggering at least one of a different type of sensor, selectively a light sensor, sound level sensor, touch sensor, motion sensor, or moisture sensor, clapping, different sound level or ultrasonic sound command.

* * * * *